US006286280B1

(12) United States Patent
Fahmy et al.

(10) Patent No.: US 6,286,280 B1
(45) Date of Patent: Sep. 11, 2001

(54) FLAME RETARDANT COMPOSITE SHEATHING

(75) Inventors: Mohamed A. Fahmy, Kalamazoo; Rod Slone, Vicksburg, both of MI (US)

(73) Assignee: Tyco Plastic Services AG (CH)

( * ) Notice: Subject to any disclaimer, the term of this patent is extended or adjusted under 35 U.S.C. 154(b) by 0 days.

(21) Appl. No.: 09/568,735

(22) Filed: May 11, 2000

(51) Int. Cl.[7] ..... E04B 5/00

(52) U.S. Cl. ..... 52/408; 52/309.3; 52/309.13; 52/783.1; 52/796.1; 428/461; 428/511; 428/535

(58) Field of Search ..... 52/309.3, 309.13, 52/408, 409, 506.01, 783.1, 784.11, 796.1; 428/461–464, 507, 508, 511, 512, 513, 534, 535

(56) References Cited

U.S. PATENT DOCUMENTS

| | | | | |
|---|---|---|---|---|
| 383,101 | * | 5/1888 | Chadd | 52/390 |
| 2,343,740 | * | 3/1944 | Birmingham | 428/106 |
| 2,695,854 | * | 11/1954 | Mullen | 428/154 |
| 2,893,907 | * | 7/1959 | Bove | 52/309.1 |
| 3,125,479 | * | 3/1964 | Finan | 52/408 X |
| 4,350,734 | * | 9/1982 | Hammond | 428/308.4 |
| 4,425,746 | * | 1/1984 | Bonaguidi | 52/309.12 |
| 4,707,961 | * | 11/1987 | Nunley et al. | 52/408 |
| 4,774,148 | * | 9/1988 | Goto | 428/607 |
| 4,877,476 | * | 10/1989 | Wolf | 156/307.3 |
| 5,096,759 | * | 3/1992 | Simpson et al. | 52/409 X |
| 5,231,814 | * | 8/1993 | Hageman | 52/408 |
| 5,518,799 | * | 5/1996 | Finestone et al. | 428/511 X |
| 5,660,924 | * | 8/1997 | Yamaji et al. | 442/378 |
| 5,700,586 | * | 12/1997 | Laiho et al. | 428/507 |
| 6,193,827 | * | 2/2001 | Parks et al. | 156/82 |

* cited by examiner

*Primary Examiner*—Beth A. Stephan
*Assistant Examiner*—Brian E. Glessner
(74) *Attorney, Agent, or Firm*—Donald R. Fraser

(57) ABSTRACT

A flame retardant composite sheathing including a core layer, having a plurality of superposed layers of a water-resistant paperboard adhered together by layers of an adhesive positioned intermediate and contacting adjacent said layers of water-resistant paperboard, a first layer of a polyolefin adhered to a major surface of the core layer, a metal foil adhered to the first layer of polyolefin, a second layer of a polyolefin adhered to the metal foil, and a layer of water resistant liner board adhered to the second layer of polyolefin.

26 Claims, 2 Drawing Sheets

FLAME RETARDANT COMPOSITE SHEATHING

FIELD OF THE INVENTION

This invention relates generally to a flame retardant composite sheathing. More particularly, the invention is directed to a multi-layered, laminated, composite sheathing material which prevents the passage of water therethrough and is flame retardant.

BACKGROUND OF THE INVENTION

Composite sheathing materials are widely used in the building and construction industries as roof components or panels, for sheathing the surfaces which form the exterior roof of a building. Such sheathing materials may be exposed to liquid water from rain or melting snow. Preferred sheathing materials prevent the passage of liquid water from the exterior to the interior of the building, while also providing Class C fire resistance to the roof structure. Conventional composite sheathing materials, while preventing the passage of liquid water therethrough, typically are manufactured from wood and bituminous components which may easily catch fire which spreads to the remaining building structure.

It would be desirable to prepare a composite sheathing material that would substantially prevent the passage therethrough of liquid water while also providing a Class C fire resistance rating to the roof structure.

SUMMARY OF THE INVENTION

Accordant with the present invention, there has surprisingly been discovered a composite sheathing material which is water-proof and flame retardant. The composite sheathing material, comprises:

- a core layer, comprising a plurality of superposed layers of a water-resistant paperboard, said layers of water-resistant paperboard being adhered together by layers of an adhesive positioned intermediate and contacting adjacent said layers of water-resistant paperboard;
- a first layer of a polyolefin adhered to a major surface of the core layer;
- a metal foil adhered to the first layer of polyolefin;
- a second layer of a polyolefin adhered to the metal foil; and
- a layer of water-resistant liner board adhered to the second layer of polyolefin.

Also contemplated as part of the present invention is a built up roof structure including a composite sheathing material.

The inventive composite sheathing material according to the present invention is particularly useful as a component in a building roof structure.

DETAILED DESCRIPTION OF THE PREFERRED EMBODIMENT

Figure 1:
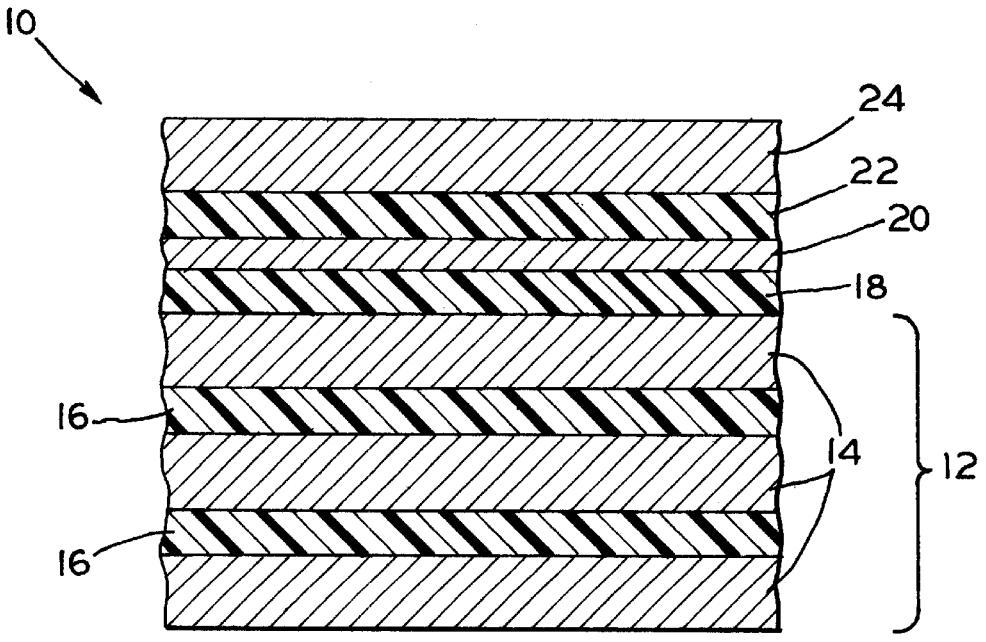
FIG. 1 is a schematic representation of an elevation view of a flame retardant composite sheathing material according to the present invention.

Referring now to FIG. 1, there is shown generally at 10 a schematic representation of a flame retardant composite sheathing material according to the present invention. The flame retardant composite sheathing material 10 comprises: a core layer 12, comprising a plurality (3 layers in the illustrated embodiment) of superposed layers of a water-resistant paperboard 14 adhered together by layers of an adhesive 16 positioned intermediate and contacting adjacent layers of the water-resistant paperboard 14; a first layer of a polyolefin 18 adhered to a surface of the core layer 12; a metal foil 20 adhered to the first layer of polyolefin 18; a second layer of a polyolefin 22 adhered to the metal foil 20; and a layer of water-resistant liner board 24 adhered to the second layer of polyolefin 22.

The core 12 layers of water-resistant paperboard 14 are well-known materials conventionally used to manufacture laminated construction materials. By the term "paperboard" as it is used herein is meant all forms of paper and paper board-like materials known as useful for manufacturing composite structures. Particularly useful paperboard materials include kraft paper which is made primarily from pine wood by digestion with a mixture of caustic soda, sodium sulfate, sodium carbonate, and sodium sulfide. The paperboard may additionally contain conventional paper adjutants such as, for example, strength increasing agents, sizing agents such as, for example, paste rosin, liquid rosin, dispersed rosin, alkyl ketene dimer, alkenyl succinic anhydride, styrene maleic anhydrike, wax emulsions, and latex polymer emulsions, preservatives, fillers, clays, kaolin, talc, barium sulfate, calcium carbonate, and the like. The water-resistant paperboard may vary in thickness over wide limits from about 0.003 inch to about 0.2 inch. The thicknesses of the individual water-resistant paperboard layers may be the same or different. A preferred water-resistant paperboard having a thickness of about 0.028 inch may be obtained from Tenneco Packaging.

The adhesive layers may comprise any water-based or organic substance that can be applied to the exposed major surfaces of the paperboard layers, capable of adhering the layers of paperboard to one another. Useful adhesives include, but are not necessarily limited to, water-based materials such as soluble silicates, phosphate cerments, animal-based glues, starch cellulosics, mucilages, and the like, and synthetic materials such as silicates, urethanes, acrylics, polychloroprenes, etc. The adhesive layers alternatively may comprise hydrocarbon resins, rubber latex compounds, elastomer-solvent cements, thermoplastic resins, thermosetting resins, and the like. Preferred adhesives include water-based adhesives. A particularly preferred adhesive comprises an opaque water-based coating which is available from Flint Ink Corporation under the product designation "R1W 01549."

The first and second layers of polyolefin according to the present invention may comprise polymers including, but are not necessarily limited to, low, medium, or high density polyethylene, polypropylene, polybutenes, polyisoprene, copolymers of ethylene and/or propylene with one or more copolymerizable monomers such as, for example, styrene, vinyl acetate, acrylic acid, methacrylic acid, methyl methacrylate, butadiene, isoprene, and the like, as well as blends and copolymers of these materials. The first and second layers of polyolefin may be the same or different.

The weight of the first and second polyolefin layers may vary over wide limits from about 2 to about 20 pounds per thousand square feet. Preferably, each polyolefin layer has a weight of 5 pounds per thousand square feet. The weights of the first and second polyolefin layers may be the same or different. A preferred polymer for preparing the first and second polyolefin layers comprises low density polyethylene available from Chevron Chemicals under the product designation "LDPE 1017."

The metal foil useful for preparing the fire retardant composite sheathing according to the present invention may comprise, by way of example but not limitation, foils prepared from aluminum, copper, lead, zinc, tin, steel, and the like, as well as alloys thereof. The thickness of the metal foil may vary over wide limits from about 0.003 inch to 0.01 inch. Preferably, the thickness of the metal foil is about 0.002 inch. A preferred metal foil may be obtained from Ormet Aluminum Products under the product designation "1235 Converter Matte—MLI."

The water-resistant liner board is a well-known material conventionally used to manufacture laminated products. It comprises a relatively inexpensive, generally stiff paper product made by a process similar to that for manufacturing paperboard. The liner board may be made water resistant by the application thereto of a material such as, for example, starch, gelatin, casein, gum, oil, wax, a silicate, a resin, a water soluble polymer, or the like, as well as mixtures thereof. The weight of the water-resistant liner board ay vary over wide limits from about 26 to about 90 pounds per thousand square feet. Preferably, the water-resistant liner board has a weight of about 62 pounds per thousand square feet. A particularly preferred water-resistant line board may be obtained from Tenneco Packaging under the product designation "62# KRAFT LINER BOARD."

Figure 2:
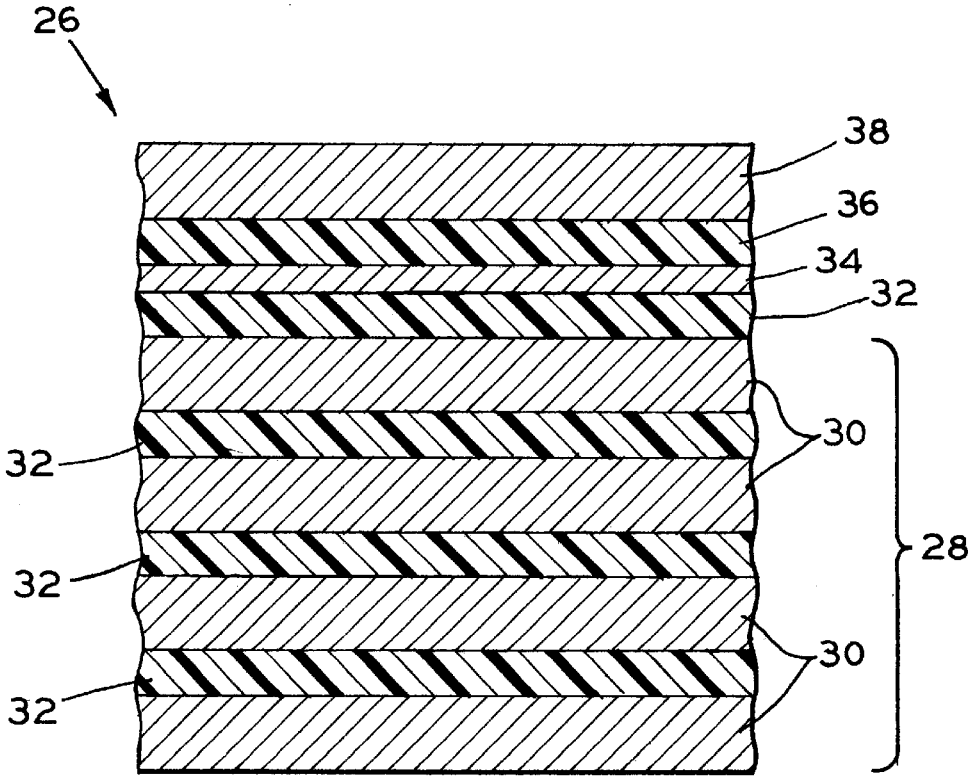
FIG. 2 is a schematic representation of an elevation view of an alternative embodiment of a flame retardant composite sheathing material according to the present invention.

In an alternative embodiment of the fire retardant composite sheathing according to the present invention illustrated in FIG. 2, there is shown generally at 26 a flame retardant composite sheathing material. It comprises: a core layer 28, comprising a plurality (4 layers in the illustrated embodiment) of superposed layers of water-resistant paperboard 30 adhered together by layers of adhesive 32 positioned intermediate and contacting adjacent layers of the water-resistant paperboard 30; a first layer of polyolefin 32 adhered to a surface of the core layer 28; a metal foil 34 adhered to the first layer of polyolefin 32; a second layer of polyolefin 36 adhered to the metal foil 34; and a layer of water-resistant liner board 38 adhered to the second layer of polyolefin 36.

FIGS. 1 and 2 illustrate that the core layer of the flame retardant composite sheathing according to the present invention may comprise virtually any number of multiple layers of water-resistant paperboard adhered one to another by means of interposed layers of adhesive.

Figure 3:
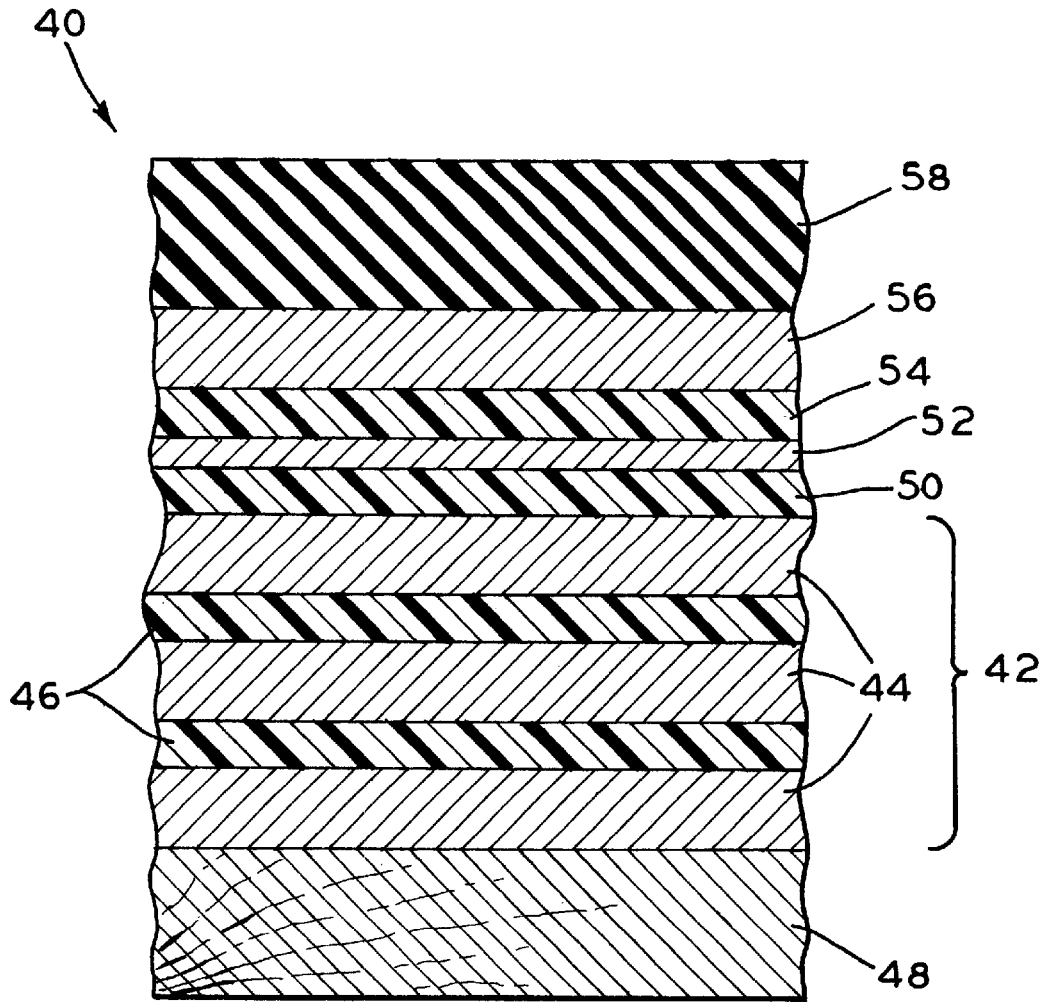
FIG. 3 is a schematic representation of an elevation view of a built-up roof deck including a flame retardant composite sheathing material embodying the features of the present invention.

In yet another alternative embodiment illustrated in FIG. 3, there is shown generally at 40 a built-up roof structure comprising the flame retardant composite sheathing according to the present invention. It comprises: a core layer 42, comprising a plurality (4 layers in the illustrated embodiment) of superposed layers of water-resistant paperboard 44 adhered together by layers of adhesive 46 positioned intermediate and contacting adjacent layers of the water-resistant paperboard 44; a wood-based panel 48 adjacent a surface of the core layer 42; a first layer of polyolefin 50 adhered to the surface of the core layer 42 opposite the surface adjacent the wood-based panel 48; a metal foil 52 adhered to the first layer of polyolefin 50; a second layer of polyolefin 54 adhered to the metal foil 52; a layer of water-resistant liner board 56 adhered to the second layer of polyolefin 54; and a water-proof membrane 58 adjacent the layer of water-resistant liner board 56. By the term "adjacent" as it is used herein to describe the location of the wood-based panel 48 relative to the core layer 42 and the water-proof membrane 58 relative to the liner board 56 is meant that these plies are either physically contacting each other, or that these plies are separated only by a conventional coating or adhesive (not shown).

The wood-based panel useful for practicing that present invention may be selected from wood products conventionally used for constructing residential and commercial built-up roofs including, but not necessarily limited to, plywood, ship board, oriented strand board, insulation board, hardboard, particle board, and the like, as well as multilayered products made therefrom. The thickness of the wood-based panel may vary over wide limits from about ⅛ inch to about 2 inches.

The water-proof membrane according to the present invention may be selected from those membranes conventionally used to construct built-up roof structures including, but not necessarily limited to, terpolymers of ethylene and propylene (EPDM rubbers), blends of polypropylene and ethylen-propylene rubber (TPO's), polyvinyl chlorides (PVC's), and the like, as well as multilayerd laminates thereof.

The various components of the flame retardant composite sheathing are assembled and laminated together by conventional means to form the final product. In a preferred process, the core layer is manufactured first, by contacting together plies of paperboard bearing layers of adhesive therebetween. This assemblage is laminated together by heat and pressure, to form the core layer. The core layer thereafter is coated with polyolefin. This may be accomplished by conventional coating techniques such as, for example, spreading, spraying, or role coating a polyolefin resin onto the core layer. Alternatively, a film of polyolefin may be contacted to the surface of the core layer. Next, a metal foil generally payed-out from a supply roll is contacted to the surface of the polyolefin layer. A second polyolefin layer is applied to the exposed surface of the metal foil. Finally, water-resistant liner board is contacted to the exposed surface of the second polyolefin layer. Thereafter, the entire assemblage is laminated together using heat and pressure in a conventional lamination process, under conditions which cause the polyolefin layers to adhere to the adjacent plies.

As will be readily apparent to one ordinarily skilled in the art, the process for manufacturing the flame retardant composite sheathing according to the present invention may be practiced as a continuous lamination process by using uninterrupted webs of kraft paper having an adhesive coating, and webs of metal foil, polyolefin, and water-resistant liner board.

In the embodiment illustrated in FIG. 3, the flame retardant composite sheathing is placed adjacent to a wood-based panel, and overlaid with an adjacent water-proof membrane. The flame retardant composite sheathing may or may not be adhered to the wood-based panel and/or the water-proof membrane by means of a conventional adhesive.

Unlike conventional composite sheathing materials conventionally used in the construction industry for roof structures, the flame retardant composite sheathing according to the present invention displays a UL Class C fire rating.

From the foregoing description, one ordinarily skilled in the art may easily ascertain the essential characteristics of this invention and, without departing from its spirit or scope, can make various changes and modifications to adapt the invention to various uses and conditions. For example, while FIG. 1 and FIG. 2 illustrate the use of three or four layers of water-resistant paperboard in the core layer, the invention contemplates any number of water-resistant paperboard layers greater than one, depending upon the thickness desired in the final product.

What is claimed is:

1. A flame retardant composite sheathing, comprising:

a core layer, comprising a plurality of superposed layers of a water-resistant paperboard, said layers of water-resistant paperboard being adhered together by layers of an adhesive positioned intermediate and contacting adjacent said layers of water-resistant paperboard;

a first layer of a polyolefin adhered to a major surface of the core layer;

a metal foil adhered to the first layer of polyolefin;

a second layer of a polyolefin adhered to the metal foil; and a layer of water-resistant liner board adhered to the second layer of polyolefin.

2. The flame retardant composite sheathing according to claim 1, wherein the thicknesses of the water-resistant paperboard layers each, individually range from about 0.003 inch to about 0.2 inch.

3. The flame retardant composite sheathing according to claim 1, wherein the thicknesses of the water-resistant paperboard layers are each, individually about 0.028 inch.

4. The flame retardant composite sheathing according to claim 1, wherein the adhesive is a water-based material.

5. The flame retardant composite sheathing according to claim 1, wherein the first layer of polyolefin comprises low density polyethylene.

6. The flame retardant composite sheathing according to claim 1, wherein the second layer of polyolefin comprises low density polyethylene.

7. The flame retardant composite sheathing according to claim 1, wherein the first and second layers of polyolefin are different.

8. The flame retardant composite sheathing according to claim 1, wherein the weight of the first polyolefin layer ranges from about 2 to about 20 pounds per thousand square feet.

9. The flame retardant composite sheathing according to claim 1, wherein the weight of the second polyolefin layer ranges from about 2 to about 20 pounds per thousand square feet.

10. The flame retardant composite sheathing according to claim 1, wherein the weight of the first polyolefin layer is about 5 pounds per thousand square feet.

11. The flame retardant composite sheathing according to claim 1, wherein the weight of the second polyolefin layer is about 5 pounds per thousand square feet.

12. The flame retardant composite sheathing according to claim 1, wherein the metal foil is prepared from a metal comprising tin, lead, copper, aluminum, zinc, steel, or an alloy thereof.

13. The flame retardant composite sheathing according to claim 1, wherein the thickness of the metal foil ranges from about 0.003 inch to about 0.01 inch.

14. The flame retardant composite sheathing according to claim 1, wherein the thickness of the metal foil is about 0.002 inch.

15. The flame retardant composite sheathing according to claim 1, wherein the weight of the water-resistant liner board ranges from about 26 to about 90 pounds per thousand square feet.

16. The flame retardant composite sheathing according to claim 1, wherein the weight of the water-resistant liner board is about 62 pounds per thousand square feet.

17. A flame retardant composite sheathing, comprising:

a core layer, comprising a plurality of superposed layers of a water-resistant paperboard, said water resistant paperboard layers each, individually having thicknesses ranging from about 0.003 inch to about 0.2 inch, said layers of water-resistant paperboard being adhered together by layers of a water-based adhesive positioned intermediate and contacting adjacent said layers of water-resistant paperboard;

a first layer of a polyolefin adhered to a major surface of the core layer, said first polyolefin layer comprising low density polyethylene, said first polyolefin layer having a weight ranging from about 2 to about 20 pounds per thousand square feet;

a metal foil adhered to the first layer of polyolefin, said metal foil being prepared from a metal comprising tin, lead, copper, aluminum, zinc, steel, or an alloy thereof, said metal foil having a thickness ranging from about 0.003 inch to about 0.01 inch;

a second layer of a polyolefin adhered to the metal foil, said second polyolefin layer comprising low density polyethylene, said second polyolefin layer having a weight ranging from about 2 to about 20 pounds per thousand square feet; and a layer of water-resistant liner board adhered to the second layer of polyolefin, said water-resistant liner board having a weight ranging from about 26 to about 90 pounds per thousand square feet.

18. The flame retardant composite sheathing according to claim 17, wherein the thicknesses of the water-resistant paperboard layers each, individually about 0.028 inch.

19. The flame retardant composite sheathing according to claim 17, wherein the first and second layers of polyolefin are different.

20. The flame retardant composite sheathing according to claim 17, wherein the weight of the first polyolefin layer is about 5 pounds per thousand square feet.

21. The flame retardant composite sheathing according to claim 17, wherein the weight of the second polyolefin layer is about 5 pounds per thousand square feet.

22. The flame retardant composite sheathing according to claim 17, wherein the thickness of the metal foil is about 0.002 inch.

23. The flame retardant composite sheathing according to claim 17, wherein the weight of the water-resistant liner board is about 62 pounds per thousand square feet.

24. A flame retardant composite sheathing, comprising:

a core layer, comprising a plurality of superposed layers of a water-resistant paperboard, said water-resistant paperboard layers each, individually having thicknesses of about 0.028 inch, said layers of water-resistant paperboard being adhered together by layers of a water-based adhesive positioned intermediate and contacting adjacent said layers of water-resistant paperboard;

a first layer of a polyolefin adhered to a major surface of the core layer, said first polyolefin layer comprising low density polyethylene, said first polyolefin layer having a weight of about 5 pounds per thousand square feet;

a metal foil adhered to the first layer of polyolefin, said metal foil being prepared from a metal comprising tin, lead, copper, aluminum, zinc, steel, or an alloy thereof, said metal foil having a thickness of about 0.002 inch;

a second layer of a polyolefin adhered to the metal foil, said second polyolefin layer comprising low density polyethylene, said second polyolefin layer having a weight of about 5 pounds per thousand square feet; and a layer of water-resistant liner board adhered to the second layer of polyolefin, said water-resistant liner board having a weight of about 62 pounds per thousand square feet.

25. A built-up roof structure, comprising:

a wood-based panel;

a fire retardant composite sheathing according to claim 1, adjacent the wood-based panel; and a water proof membrane adjacent the fire retardant composite sheathing.

26. A built-up roof structure, comprising:

a wood-based panel;

a fire retardant composite sheathing according to claim 17, adjacent the wood-based panel; and a water proof membrane adjacent the fire retardant composite sheathing.

* * * * *